United States Patent [19]
Hennequin

[11] 4,194,551
[45] Mar. 25, 1980

[54] END PIECE FOR THE BOTTOM RAIL OF A VENETIAN BLIND

[75] Inventor: Petrus J. Hennequin, Rotterdam, Netherlands

[73] Assignee: Hunter Douglas International N.V., Netherlands Antilles

[21] Appl. No.: 911,826

[22] Filed: Jun. 2, 1978

[30] Foreign Application Priority Data

Jun. 11, 1977 [DE] Fed. Rep. of Germany ..... 2726516

[51] Int. Cl.[2] ..... E06B 9/38
[52] U.S. Cl. ..... 160/178 R
[58] Field of Search ..... 160/166–178

[56] References Cited

U.S. PATENT DOCUMENTS

| | | | |
|---|---|---|---|
| 1,914,050 | 6/1933 | Smith | 160/176 |
| 2,365,004 | 12/1944 | Rice et al. | 160/177 |
| 2,390,826 | 12/1945 | Cohn | 160/176 |
| 2,565,217 | 8/1951 | Frank | 160/172 |

FOREIGN PATENT DOCUMENTS

| | | | |
|---|---|---|---|
| 2304809 | 8/1974 | Fed. Rep. of Germany | 160/176 |

*Primary Examiner*—Peter M. Caun
*Attorney, Agent, or Firm*—Pennie & Edmonds

[57] ABSTRACT

There is disclosed an end piece for the bottom rail of a venetian blind which end piece is engaged by a flexible lifting member for the blind and a flexible tilting member both of which are positioned within the side housing of the blind. The flexible tilting member engages the end piece in sliding relationship such that movement of the flexible tilting member does not result in tilting of the bottom rail. Further, a portion of the end piece of the bottom rail is engaged for vertical movement in a slot in the housing in such a manner as to further insure against tilting of the bottom rail while permitting vertical adjustment thereof. The arrangements for engaging the lifting tape of the lifting member and the flexible tilting member with the end piece are such as to provide for very ready assembly while insuring against accidental disconnection.

9 Claims, 4 Drawing Figures

END PIECE FOR THE BOTTOM RAIL OF A VENETIAN BLIND

BACKGROUND

1. Field of Invention

In venetian blinds of the type to which this invention pertains the tilting members engage each of the individual slats at certain points or engage connectors connected to each individual slat in such a way that operation of the flexible tilting member provides for simultaneous tilting adjustment of all of the slats from a fully open to a fully closed position and any selected position therebetween. Such tilting members generally extend to the bottom rail and are connected therewith in such a manner that the bottom rail executes a corresponding tilting motion upon actuation of the tilting members.

In many blinds of this type at least a portion of the tilting member or the lifting member may be exposed to view rather than hidden within the housing. Still further, known blinds of this type have time consuming and expensive arrangements for engaging the lifting member or the tilting member or both with the bottom rail. As such the overall cost of the blind is adversely affected by the labor cost of securing these flexible members to the bottom rail.

2. Prior Art

In the U.S. Pat. No. 2,365,004 there is disclosed a venetian blind in which the lifting member and the tilting member are in large part concealed from view in suitable housings. In the blind disclosed in this patent the lifting member passes through the bottom rail through an opening therein where it is secured by a small abutment that appears from the drawing to be a knot or the like. The connection of the tilting members to the bottom rail is not shown but, presumably, is of the same arrangement.

It will be appreciated that passing these flexible members through the openings in the bottom rail and then knotting the same or affixing an abutment member thereto entails time consuming and expensive hand labor which adds to the cost of the blind. Also, operation of the tilting member necessarily also tilts the bottom rail.

BRIEF DESCRIPTION OF THE INVENTION

The present invention is directed toward means for securing the flexible lifting member and the flexible tilting member to the bottom rail of a venetian blind in such a way as to permit very rapid and easy assembly and, additionally, to prevent simultaneous tilting movement of the bottom rail when adjusting the tilting member.

To this end the present invention comprises an end piece attachable to the end of a bottom rail which end piece has a projection extending through a slot in the side housing of a venetian blind. This projection has two axially separated zones or areas the outer of which is engaged by the flexible lifting member which is preferably a tape of fabric material and the inner most zone or area is engaged by the tilting member in sliding relationship therewith.

Still further inwardly (toward the bottom rail) from the inner most of said two zones is a third portion of the projection which serves to guide the bottom rail by loose engagement within the slot through which the projection extends. This area of the projection is elongated vertically and as such prevents rotation or tilting of the bottom rail in cooperation with the sliding relationship above mentioned between the tilting member and its associated zone of the projection.

In one embodiment of the invention the lifting member, comprised of a tape as above mentioned, has the bottom end thereof folded back upon itself with the end stitched, adhered, or otherwise secured to the rest of the tape thus providing a loop on the bottom end of the lifting member which may simply be entrained under the projection of the end piece of the bottom rail. Suitably axially spaced flanges prevent disengagement of this loop with the projection together with an overlying cantilevered member secured to one of the flanges and spaced from the other thereof to provide a threading slot through which the tape may be passed to engage the end piece projection.

One of the above mentioned flanges together with still a third flange defines the area or zone of engagement of the flexible tilting member with the projection of the end piece and serves to retain the tilting member in position and in sliding engagement therewith. One of said flanges has extending therefrom a second cantilevered member which is spaced slightly from the other said flange sufficiently to provide another threading slot through which the flexible tilting member may be passed into engagement with the appropriate zone of the projecting end piece. These slots, while sufficient to permit assembly and engagement as above mentioned also are such that they guard against accidental displacement of the lifting member and flexible tilting member in substantially all operative positions of the venetian blind.

In another embodiment of the invention instead of the cantilevered members it is proposed that the flanges have bores therein and that after engagement of the lifting member and the tilting member with the projection in their respective zones, then a pin is passed through the bores of said flanges to maintain the lifting and tilting members securely in place.

It is also contemplated that rollers may be utilized on the projection of the end piece for that portion in engagement with the guiding slot of the housing, for that zone in engagement with the tilting member, or that zone in engagement with the lifting member or any two or all thereof. Such a roller reduces wear and provides for ready slipping by the members where desired.

In another embodiment the lower end of the tape of the lifting member passes through the projection of the end piece through a suitable wedge shaped opening and is wedged in place by means of a locking element such that the weight of the bottom rail tends to maintain the locking element wedged in place in the projection with the tape of the lifting member securely wedged in place in the projection. Such an arrangement precludes the necessity of forming a loop at the bottom end of a lifting member tape and will therefore be a more economical arrangement for certain assembly operations.

BRIEF DESCRIPTION OF THE DRAWINGS

The construction of the invention and its use will be apparent to those skilled in the art from the following specification and drawings in which.

DETAILED DESCRIPTION OF THE INVENTION

Figure 1:
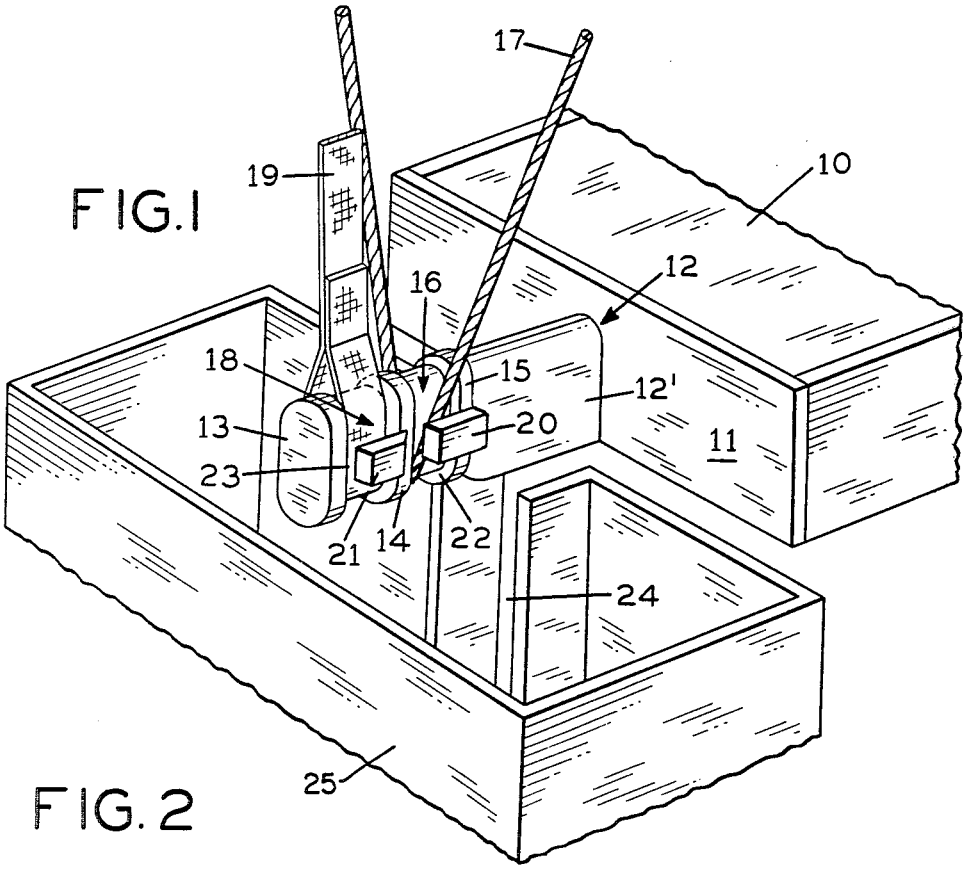
FIG. 1 is a perspective view of one end of a bottom rail, its associated end piece, and a portion of the side housing of the venetian blind in which the same is used.

As shown in FIG. 1 the bottom rail 10 of a venetian blind has secured thereto by any suitable means, not shown, end piece 11 including a peg type projection 12 extending substantially axially outwardly along the longitudinal axis of the botton rail 10. The projection 12 includes an inner portion 12' which loosely engages within a slot 24 extending vertically of the side housing 25 of the venetian blind. As shown, the inner portion 12' of the projection 12 is of a lateral dimension to engage the slot 24 with a minimum amount of friction and is vertically elongated thus to prevent rotation of the bottom rail 10 about its longitudinal axis. Outwardly of the inner portion 12' the projection 12 has two adjacent zones or areas 16 and 18 defined by radial flanges 13, 14 and 15.

Secured to flange 15 and extending therefrom toward flange 14 is a guiding and securing member 20 which is cantilevered from the flange 15 and which terminates short of the flange 14 thus providing a slot 22 through which flexible tilting member 17 may be passed to engage around the projection 12 in the zone 16. As shown, the slot 22 widens outwardly thus aiding in the engagement of the flexible tilting member 17 into and through the slot 22 and into proper position in the zone 16. Once the tilting member 17 is in place the overlying cantilevered member 20 serves to guard against accidental displacement of the member 17 from the zone 16 of the projection 12. It will be appreciated from FIG. 1 that the member 17 loops below and around the projection 12 so that there are two generally upward extending "runs" to the tilting member 17 which may be of the ladder type or of any other known type of tilting member. Extending from the flange 14 toward the flange 13 but ending short thereof is a second cantilevered member 21 which is associated with the zone 18. A slot 23 is provided between the outer end of cantilevered member 21 and the flange 13 to permit passage therethrough of the tape of the lifting member 19. As shown in FIG. 1 the lifting member 19 has its lower end folded back upon itself and secured to the major portion thereof to provide a loop for engagement about the projection 12 in the zone 18. Conveniently, the slot 23 may also open wider outwardly to help with the insertion of the material of the tape 19.

It will be appreciated that it would be possible to have the cantilivered member 21 extend from the flange 13 toward the flange 14 thus providing the slot 23 adjacent to the flange 14 rather than the flange 13. Also, the cantilevered member 20 could extend from flange 14 toward but short of the flange 15 thus providing the slot 22 at the opposite end of the cantilevered member 20 adjacent to flange 15. Similarily, a single cantilivered member could be secured to the member 14 at its center and extend outwardly toward but short of each of members 13 and 14. Such modifications are clearly within the scope and intent of the invention.

If desired any one, or all three of zones 12', 16, 18 of the projection 12 may incorporate rollers for the smooth operation of the same with respect to adjacent cooperating parts. For example, the zone 16 may incorporate a roller having an axis generally aligned with the axis of projection 12 for cooperation with the tilting member 17 or the portion 12' may incorporate one or more rollers for engagement with the flanges which define the slot 24 of housing 25. The same is true with respect to the zone 18 particularly when the lifting member engages the zone 18 in the manner shown in FIG. 3.

It will be seen that with the construction just described with reference to FIG. 1 that any forces applied to the tilting member 17 to adjust the tilt of the slats of the venetian blind will not be imparted to the bottom rail 10 due to the sliding relationship between the tilting member 17 and the zone 16 as assisted by the vertically elongated configuration of the zone 12' which, upon any unintended rotation being imparted to the projection 12 will engage the vertical flanges which define the vertical slot 24 and thus prevent any tilting of the bottom rail 10.

Figure 2:
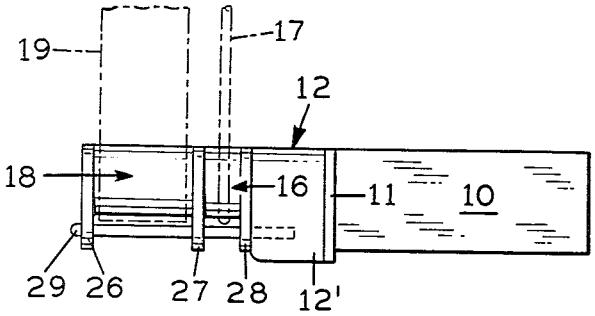
FIG. 2 shows a side elevational view of one end of a bottom rail with a modified form of end piece.
Figure 3:
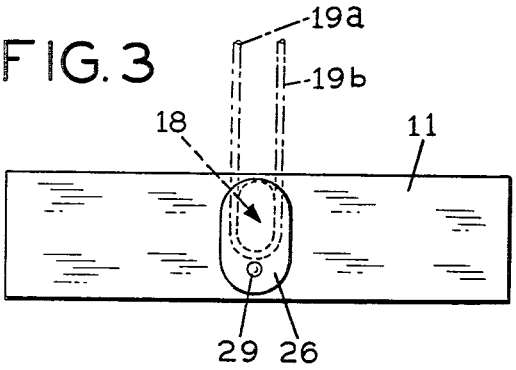
FIG. 3 is an end elevational view of the end piece shown in FIG. 2.

The form of the invention as shown in FIGS. 2 and 3 is very similar to that shown in FIG. 1 and the corresponding parts thereof are numbered with like reference numerals. The essential difference in the embodiment of FIGS. 2 and 3 is that the catilevered members 20 and 21 are eliminated and in place thereof there is provided an elongated pin 29 which passes through suitable openings in the flanges 26, 27 and 28, and into an aligned opening in the portion 12' of the projection 12. In assembling this embodiment of the invention the tilting member 17 and the lifting member 19 are first engaged in the zones 16 and 18 respectively and then the pin 29 is passed through the flanges 26, 27 and 28 successively and then into the bore in the inner portion 12' of the projection.

In order to provide suitable space for the openings in the flanges 26, 27 and 28 these flanges are extended radially downwardly a greater distance than is the case for flanges 13, 14, and 15 in the embodiment of FIG. 1. Furthermore, since the pin 29 absolutely guarantees against dislodgement it is not necessary that the flanges extend to any significant extent radially upwardly from their associated zones 16 and 18 as do the flanges 13, 14 and 15 in the embodiment of FIG. 1. However, in order to insure clear definition of the zones 16 and 18 and to prevent potential entanglement between the lifting member 19 and the tilting member 17, the flanges 26, 27 and 28 do extend radially outward laterally of the zones 16 and 18 as do the flanges 13, 14 and 15 in FIG. 1.

While the projection shown in FIG. 1, or the embodiment shown in FIGS. 2 and 3 may have its zone 18 resting in a loop at the bottom of the lifting tape 19 as shown in FIG. 1, an alternate arrangement for the lifting member is possible as indicated in FIG. 3. As shown in FIG. 3 the lifting member has two runs 19*a* and 19*b* one of which is secured at the top to the head rail and the other of which is secured in the head rail to the lifting mechanism. Thus when the blind is lifted by the lifting mechanism there will be a sliding relationship between the zone 18 and the tape 19*a*, 19*b* of the lifting member. When this type of lifting member is used it is particularly desirable to use a roller to serve as the zone 18 as well as the zone 16 or the zone 12' as discussed above.

Figure 4:
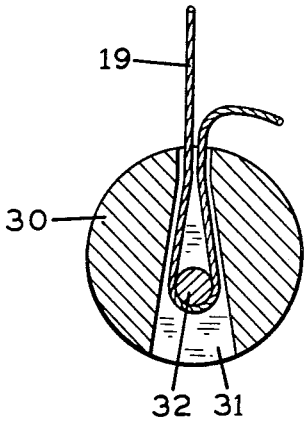
FIG. 4 is a somewhat schematic section through the projection of a still further modified end piece.

In FIG. 4 is shown still a further embodiment of the end piece projection in which that portion corresponding to the zone 18 of FIG. 1 is shown generally cylindrical although the outer shape thereof is not critical and it may be of any desired configuration. This portion 30 of the projection of the end piece of the embodiment of FIG. 4 has extending vertically therethrough an opening 31 which is of an inverted wedge shape such that its bottom opening is wider than its top opening. This permits the tape 19 of the flexible lifting member to be passed through the wedge shape opening 31 and then about a locking element 32 with the end of the tape 19 being threaded back upwardly through the narrow portion of the opening. By pulling upwardly on the tape 19 and its upwardly extending end the locking element 32 will become wedged in the opening 31 with the tape 19 secured thereabout. Additionally, the weight of the bottom rail maintains this wedged relationship. As a result, the embodiment of FIG. 4 provides for very simple assembly and eliminates the need for manufacturing a loop at the bottom of the tape 19 as is the case in embodiment of FIG. 1.

I claim:

1. In an end piece for the bottom rail of a venetian blind in which blind the slats are guided in a side housing of the blind and in which the blind is actuated by means of a flexible lifting member and a flexible tilting member both of which flexible members engage with the end piece of the bottom rail, the improvement in which the end piece of the bottom rail has a projection extending outwardly of the end of said bottom rail in generally the same direction as the length of said rail and into said side housing, said projection having two axially separated zones located within said side housing, said flexible lifting and tilting members also being located within said side housing, one of said zones being adapted to receive the end of the flexible lifting member, the other of said zones being adapted toreceive the flexible tilting member around at least the bottom portion thereof and in sliding engagement therewith, said sliding engagement being such as to permit movement of said flexible tilting member without tilting said bottom rail.

2. The end piece of claim 1 in which the flexible lifting member has a loop on its lower end, and said loop engages said projection at said one zone with said projection extending therethrough.

3. The end piece of claim 1 in which the axially separated zones of said projection are defined by radially extending flanges and in which said one zone is axially outward of the other zone.

4. The end piece of claim 3 in which there is a cantilevered member extending from one of said flanges toward but short of another of said flanges, the distance between the other of said flanges and the adjacent end of said cantilevered member providing a threading slot for one of said flexible members, and said cantilevered member aiding in retaining one of said flexible members in position in its associated zone during operation of the blind.

5. The end piece of claim 3 in which aligned openings are provided in said flanges, and a retaining pin extends through said openings to securely retain the flexible members in engagement with their respective zones.

6. The end piece of claim 1 in which the zone of said projection adapted to receive said lifting member has a wedged shaped opening therethrough, a loop on the end of said lifting members extends into said wedged shaped opening from the narrower outlet thereof, and a locking member is positioned in said loop and in tightly wedging relationship therewith and with the wedged shaped opening whereby said lifting member is retained in position.

7. The end piece of claim 1 in which said lifting member extends around the bottom of the projection in its associated zone and is in sliding engagement with its associated zone.

8. The end piece of any one of the preceding claims in which said projection also includes a third zone, said third zone being axially inward of both of the other two zones, the side housing of said blind having a vertical slot therein, said projection extending into said housing with said third zone being in loose guiding relationship with said slot, said projection being vertically elongated in said third zone, and cooperation between said third zone and said slot serving to insure against rotation of said bottom rail during operation of the tilting member.

9. In an end piece for the bottom rail of a venetian blind in which blind the slats are guided in a side housing of the blind and in which the blind is actuated by means of a flexible lifting member and a flexible tilting member both of which flexible members engage with the end piece of the bottom rail, the improvement in which the end piece of the bottom rail has a projection extending outwardly of the end of said bottom rail in generally the same direction as the length of said rail, said projection having two axially separated zones, one of said zones being adapted to receive the end of the flexible lifting member, the other of said zones being adapted to receive the flexible tilting member around at least the bottom portion thereof and in sliding engagement therewith, the axially separated zones of said projection being defined by radially extending flanges, said one zone being axially outward of the other zone, a cantilever member extending from one of said flanges toward but short of another of said flanges, the distance between the other of said flanges and the adjacent end of said cantilever member providing a threading slot for one of said flexible members, and said cantilevered member aiding in retaining one of said flexible members in position in its associated zone during operation of the blind.

* * * * *